US007669452B2

(12) United States Patent
Polen et al.

(10) Patent No.: US 7,669,452 B2
(45) Date of Patent: Mar. 2, 2010

(54) TITANIUM STRETCH FORMING APPARATUS AND METHOD

(75) Inventors: Larry Alexander Polen, Matthews, NC (US); Harold John Weber, Waxhaw, NC (US); Thomas Sandy Houston, Charlotte, NC (US)

(73) Assignee: Cyril Bath Company, Monroe, NC (US)

( * ) Notice: Subject to any disclaimer, the term of this patent is extended or adjusted under 35 U.S.C. 154(b) by 989 days.

(21) Appl. No.: 11/307,176

(22) Filed: Jan. 26, 2006

(65) Prior Publication Data

US 2007/0102493 A1 May 10, 2007

Related U.S. Application Data

(60) Provisional application No. 60/597,034, filed on Nov. 4, 2005.

(51) Int. Cl.
*B21D 31/00* (2006.01)
*B21D 11/02* (2006.01)
*B21D 37/16* (2006.01)

(52) U.S. Cl. ..... 72/364; 72/302; 72/342.5; 72/342.96

(58) Field of Classification Search ..... 72/302, 72/377, 342.1, 342.4, 342.5, 342.6, 342.7, 72/342.92, 342.94, 342.96, 364
See application file for complete search history.

(56) References Cited

U.S. PATENT DOCUMENTS 3,015,292 A 1/1962 Bridwell
3,025,905 A 3/1962 Haerr
3,550,422 A * 12/1970 Potter ..... 72/342.1
3,584,487 A 6/1971 Carlson
3,635,068 A 1/1972 Watmough et al.
3,722,068 A 3/1973 Manchester et al.
3,823,303 A 7/1974 Manchester et al.
3,933,020 A 1/1976 Orr et al.
3,965,715 A 6/1976 Parmann
3,979,815 A 9/1976 Nakanose et al.
4,011,429 A 3/1977 Morris et al.
4,145,908 A 3/1979 Miller
4,815,308 A 3/1989 Moroney
4,970,886 A 11/1990 Sikora et al.
5,086,636 A 2/1992 Huet
5,113,681 A 5/1992 Guesnon et al.

(Continued)

FOREIGN PATENT DOCUMENTS

JP 01129955 A 5/1989

(Continued)

OTHER PUBLICATIONS

Examiner's first report issued in Australian Application No. 2006311323 on Aug. 4, 2009.

*Primary Examiner*—Dana Ross
*Assistant Examiner*—Teresa M Bonk
(74) *Attorney, Agent, or Firm*—Adams Intellectual Property Law

(57) ABSTRACT

A stretch-forming apparatus includes a main frame which carries a die enclosure between jaw assemblies. An insulated die is mounted in the enclosure. A method of forming a component includes placing a workpiece in the enclosure, heating the workpiece to a working temperature using electrical resistance heating, and then stretching the workpiece against the die. The method is particularly useful for titanium workpieces.

10 Claims, 11 Drawing Sheets

U.S. PATENT DOCUMENTS

| | | | | |
|---|---|---|---|---|
| 6,071,360 | A | 6/2000 | Gillespie | |
| 6,463,779 | B1 | 10/2002 | Terziakin | |
| 6,550,124 | B2 | 4/2003 | Krajewski et al. | |
| 6,679,091 | B2 * | 1/2004 | Yamada et al. | 72/296 |
| 6,897,407 | B2 | 5/2005 | Gomez | |
| 2003/0217991 | A1 | 11/2003 | Gomez | |
| 2005/0199031 | A1 | 9/2005 | Hammar | |

FOREIGN PATENT DOCUMENTS

| | | | |
|---|---|---|---|
| JP | 2002210529 | A | 7/2002 |
| RU | 2 170 771 | C2 | 7/2001 |

* cited by examiner

TITANIUM STRETCH FORMING APPARATUS AND METHOD

TECHNICAL FIELD AND BACKGROUND OF THE INVENTION

This invention relates to forming metallic components, and more specifically to hot stretch forming and creep forming of titanium and its alloys.

Stretch forming is a well-known process used to form curved shapes in metallic components, by pre-stretching a workpiece to its yield point while forming it over a die. This process is often used to make large aluminum and aluminum-alloy components, and has low tooling costs and excellent repeatability.

Titanium or titanium alloys are substituted for aluminum in certain components, especially those for aerospace applications. Reasons for doing so include titanium's higher strength-to weight ratio, higher ultimate strength, and better metallurgical compatibility with composite materials.

However, there are difficulties in stretch-forming titanium at room temperature because their yield point is very close to their ultimate tensile strength with a minimal percent elongation value. Therefore, titanium components are typically bump formed and machined from large billets, an expensive and time-consuming process.

Accordingly, there is a need for an apparatus and method for stretch-forming titanium and its alloys.

SUMMARY OF THE INVENTION

Accordingly, it is an object of the invention to provide a method for stretch forming and/or creep forming titanium at elevated temperatures.

It is another object of the invention to provide an apparatus for stretch forming and/or creep forming titanium at elevated temperatures.

It is another object of the invention to provide an apparatus for insulating a workpiece during a forming process.

These and other objects are met by the present invention, which according to one aspect provides a method of stretch-forming, including: providing an elongated metallic workpiece having a preselected non-rectangular cross-sectional profile; providing a die having a working face complementary to the cross-sectional profile, wherein at least the working face comprises a thermally insulated material; resistance heating the workpiece to a working temperature by passing electrical current therethrough; forming the workpiece against the working face by causing the workpiece and the die so move relative to each other while the workpiece is at the working temperature, thereby causing plastic elongation and bending of the workpiece and shaping the workpiece into a preselected final form.

According to another aspect of the invention, the workpiece comprises titanium.

According to another aspect of the invention, the cross-sectional profile has an aspect ratio of less than about 20.

According to another aspect of the invention, the cross-sectional profile is formed by a method selected from the group consisting of: extrusion, press-brake forming, roll-forming, and machining, and combinations thereof.

According to another aspect of the invention, the method includes the step of receiving opposed ends of the workpiece in jaws of a forming apparatus.

According to another aspect of the invention, the method includes the step of passing the electrical current to the workpiece through the jaws.

According to another aspect of the invention, the jaws are carried on moveable swing arms, and the step of forming the workpiece comprises moving the swing arms to wrap the workpiece around the working face.

According to another aspect of the invention, the method includes the step of controlling the working temperature while the forming is carried out.

According to another aspect of the invention, the method includes the step of creep-forming of the workpiece by maintaining the workpiece formed against the working face and at a controlled temperature for a selected dwell time.

According to another aspect of the invention, the method includes the step of surrounding the die and a first portion of the workpiece with an enclosure.

According to another aspect of the invention, the enclosure includes an opening for allowing a second portion of the workpiece to protrude from the enclosure while the forming step takes place.

According to another aspect of the invention, a stretch-forming apparatus includes: a die having a working face with a preselected non-rectangular cross-sectional profile adapted to receive and form an elongated metallic workpiece, wherein at least the working face comprises a thermally insulated material; heating means for electric resistance heating the workpiece to a working temperature; and movement means for moving the die and a workpiece relative to each other so as to cause elongation and bending of the workpiece against the working face.

According to another aspect of the invention, the die consists essentially of a ceramic material.

According to another aspect of the invention, the apparatus further includes opposed jaws for receiving respective opposed ends of the workpiece.

According to another aspect of the invention, the heating means include: source of electrical current electrically connected to the jaws; and n electrical connection between the jaws and the workpiece.

According to another aspect of the invention, the jaws are carried on moveable swing arms adapted to wrap the workpiece around the working face.

According to another aspect of the invention, the forming apparatus further includes temperature control means for controlling the working temperature while the forming is carried out.

According to another aspect of the invention, the forming apparatus further includes means for maintaining the workpiece formed against the working face at the working temperature for a selected dwell time.

According to another aspect of the invention, the forming apparatus further includes an enclosure surrounding the die and a first portion of the workpiece with an enclosure.

According to another aspect of the invention, the enclosure includes port means for allowing a second portion of the workpiece to protrude from the enclosure.

According to another aspect of the invention, a stretch-forming apparatus includes: a die having a working face adapted to receive and form an elongated metallic workpiece, wherein at least the working face comprises a thermally insulated material; heating means for electric resistance heating the workpiece to a working temperature; an enclosure adapted to surround the die and a first portion of the elongated workpiece during a forming operation, and further adapted to permit a second portion of the workpiece to protrude therefrom; and movement means for moving the die and a workpiece relative to each other so as to cause elongation and bending of the workpiece against the working face.

According to another aspect of the invention, the enclosure includes a first door moveable between an open position for permitting a workpiece to be placed in the enclosure, and a closed position.

According to another aspect of the invention, the enclosure comprises at least one side wall which includes an opening therein for allowing movement of an exterior end portion of the workpiece relative to the enclosure.

According to another aspect of the invention, the forming apparatus further includes a moveable door which substantially covers a side opening of the wall, the door having a workpiece opening therein adapted to allow a workpiece to pass therethrough, the workpiece opening being substantially smaller than the side opening.

According to another aspect of the invention, the enclosure comprises a box-like structure having top and bottom walls, front and rear walls, opposed side walls, and a door in one of the walls moveable between an open position and a closed position.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
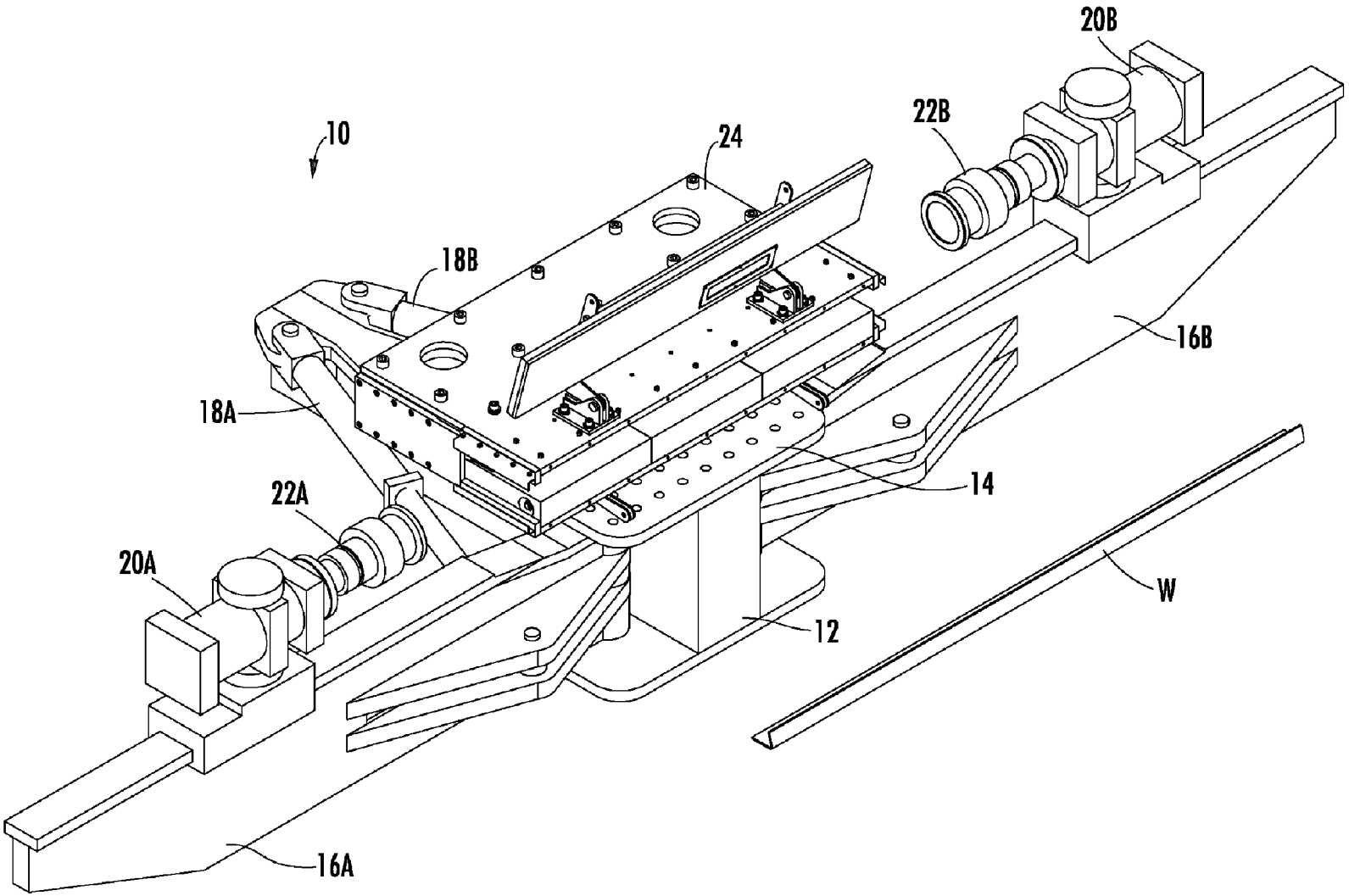
FIG. 1 is a perspective view of an exemplary stretch-forming apparatus constructed in accordance with the present invention.
Figure 10:
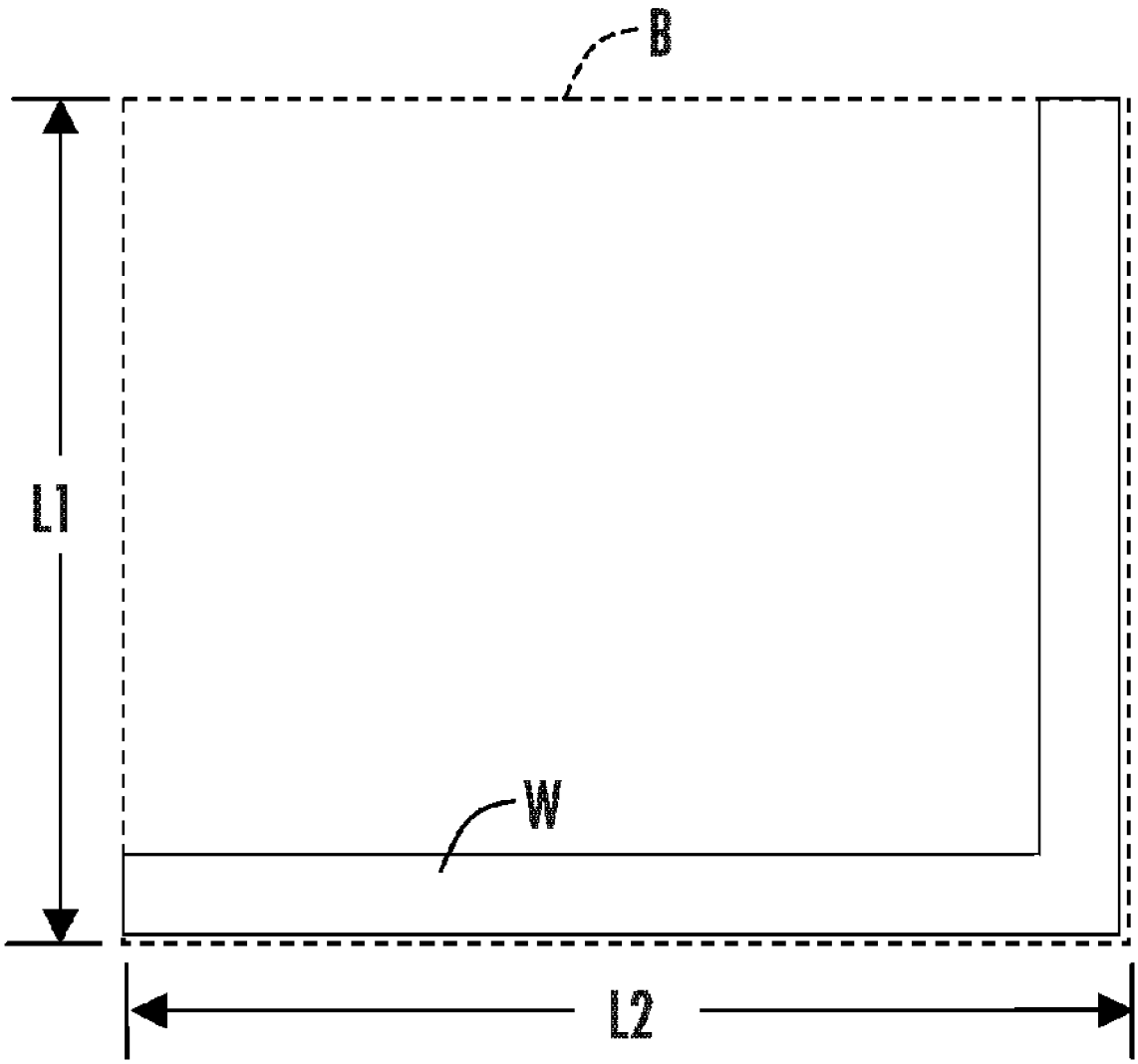
FIG. 10 is an end view of the workpiece shown in FIG. 1.

Referring to the drawings wherein identical reference numerals denote the same elements throughout the various views, FIG. 1 illustrates an exemplary stretch-forming apparatus 10 constructed in accordance with the present invention, along with an exemplary workpiece "W". As shown in FIG. 10, the workpiece W is an extrusion with an L-shaped cross-sectional profile.

The present invention is suitable for use with various types of workpieces, including but not limited to rolled flats or rolled shapes, bar stock, press-brake formed profiles, extruded profiles, machined profiles, etc. The present invention is especially useful for workpieces having non-rectangular cross-sectional profiles, and for workpieces having cross-sectional profiles with aspect ratios of about 20 or less. As shown in FIG. 10, the aspect ratio is the ratio of the lengths "L1" and "L2" of a rectangular box "B" surrounding the outer extents of the cross-sectional profile.

The apparatus 10 includes a substantially rigid main frame 12 which defines a die mounting surface 14 and supports the main operating components of the apparatus 10. First and second opposed swing arms 16A and 16B are pivotally mounted to the main frame 12 and are coupled to hydraulic forming cylinders 18A and 18B, respectively. The swing arms 16A and 16B carry hydraulic tension cylinders 20A and 20B which in turn have hydraulically operable jaw assemblies 22A and 22B mounted thereto. The tension cylinders 20 may be attached to the swing arms 16 in a fixed orientation, or they may be pivotable relative to the swing arms 16 about a vertical axis. A die enclosure 24, described in more detail below, is mounted to the die mounting surface 14 between the jaw assemblies 22A and 22B.

Appropriate pumps, valving, and control components (not shown) are provided for supplying pressurized hydraulic fluid to the forming cylinders 18, tension cylinders 20, and jaw assemblies 22. Alternatively, the hydraulic components described above could be replaced with other types of actuators, such as electric or electromechanical devices. Control and sequencing of the apparatus 10 may be manual or automatic, for example by PLC or PC-type computer.

The principles of the present invention are equally suitable for use with all types of stretch formers, in which a workpiece and a die move relative to each other to creating a forming action. Known types of such formers may have fixed or moving dies and may be horizontally or vertically oriented.

Figure 2:
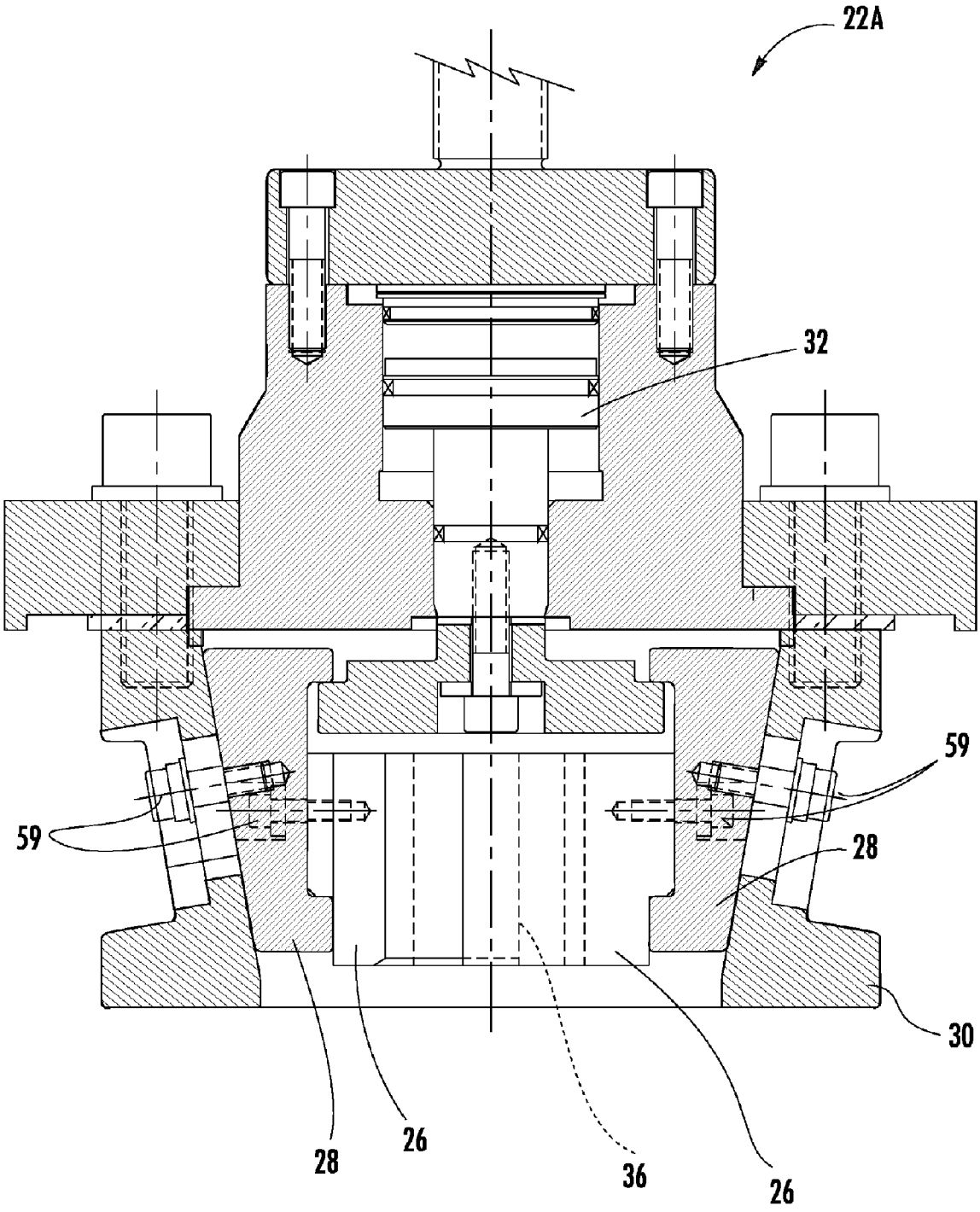
FIG. 2 is a top sectional view of a jaw assembly of the stretch-forming apparatus of FIG. 1.

FIG. 2 illustrates the construction of the jaw assembly 22A, which is representative of the other jaw assembly 22B. The jaw assembly 22A includes spaced-apart jaws 26 adapted to grip an end of a workpiece W and mounted between wedge-shaped collets 28, which are themselves disposed inside an annular frame 30. A hydraulic cylinder 32 is arranged to apply an axial force on the jaws 26 and collets 28, causing the collets 28 to clamp the jaws 26 tightly against the workpiece W. The jaw assembly 22A, or the majority thereof, is electrically insulated from the workpiece W. This may be accomplished by applying an insulating layer or coating, such as an oxide-type coating, to the jaws 26, collets 28, or both. If a coating 34 is applied all over the jaws 26 including the faces 36 thereof, then the jaw assembly 22A will be completely isolated. If it is desired to apply heating current through the jaws 26, then their faces 36 would be left bare and they would be provided with appropriate electrical connections. Alternatively, the jaws 26 or collets 28 could be constructed from an insulated material as described below with respect to the die 58, such as a ceramic material. The jaws 26 and collets 28 may be installed using insulating fasteners 59 to avoid any electrical or thermal leakage paths to the remainder of the jaw assembly 22A.

Figure 3:
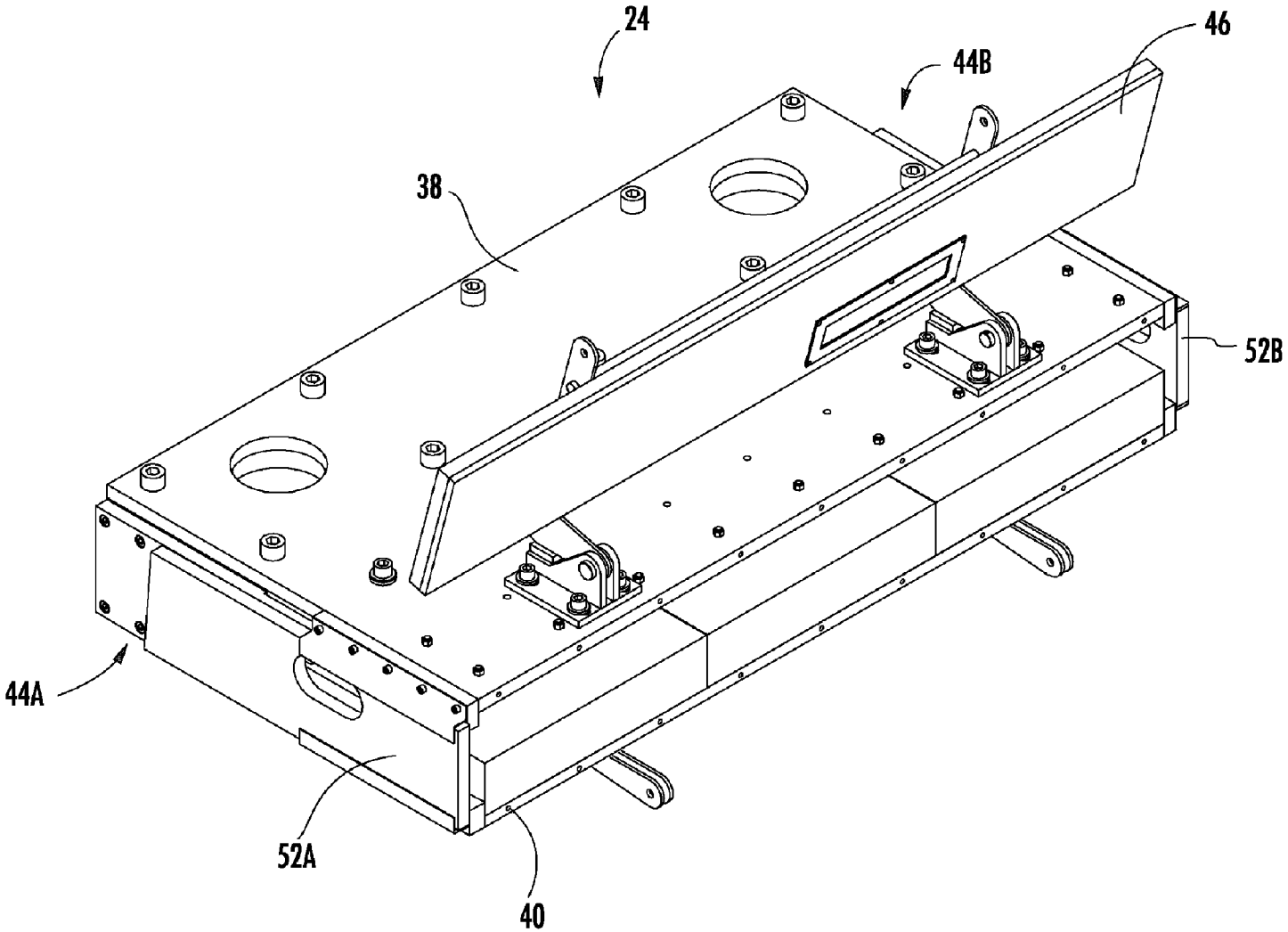
FIG. 3 is a perspective view of a die enclosure which forms part of the apparatus shown in FIG. 1, with a door thereof in an open position.
Figure 4:
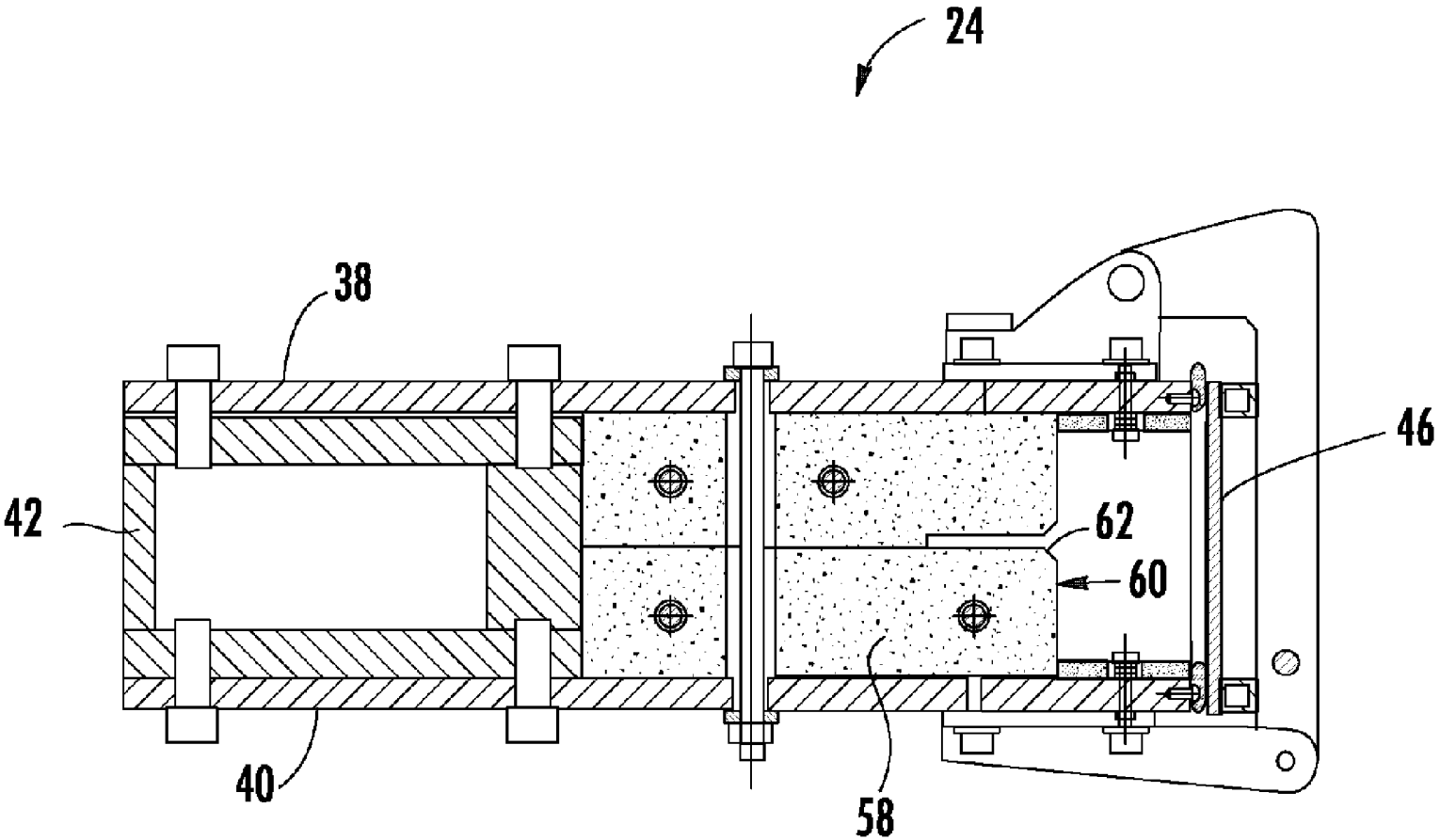
FIG. 4 is a cross-sectional view of the die enclosure shown in FIG. 3, showing the internal construction thereof.
Figure 5:
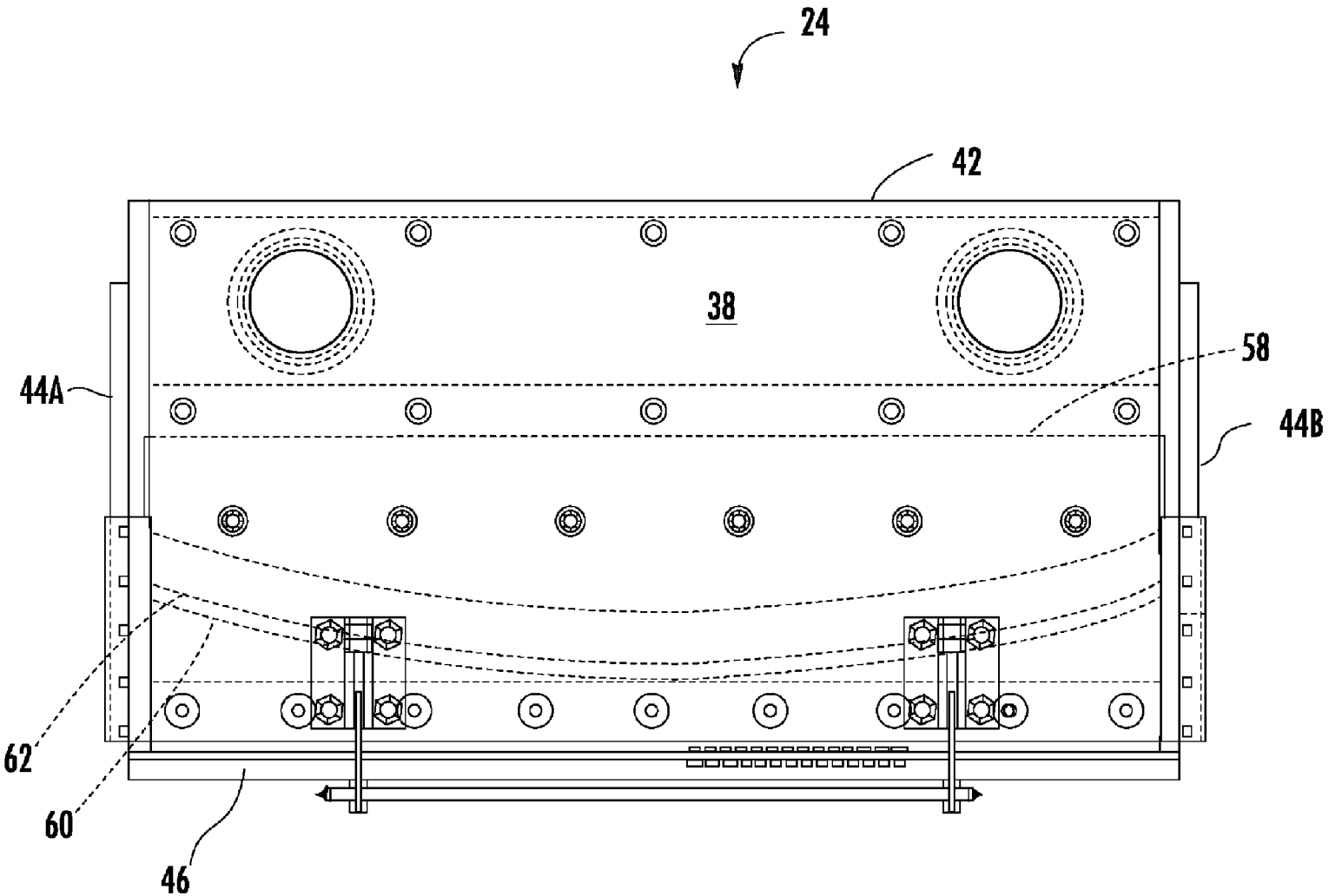
FIG. 5 is a top plan view of the die enclosure of FIG. 3.

Referring now to FIGS. 3-5, the die enclosure 24 is a box-like structure having top and bottom walls 38 and 40, a rear wall 42, side walls 44A and 44B, and a front door 46 which can swing from an open position, shown in FIG. 2, to a closed position. The specific shape and dimensions will, of course, vary depending upon the size and proportions of the workpieces to be formed. The die enclosure 24 is fabricated from a material such as steel, and is generally constructed to minimize air leakage and thermal radiation from the workpiece W. The die enclosure 24 may be thermally insulated, if desired.

A die 58 is disposed inside the die enclosure 24. The die 58 is a relatively massive body with a working face 60 that is shaped so that a selected curve or profile is imparted to a workpiece W as it is bent around the die 58. The cross-section of the working face 60 generally conforms to the cross-sectional shape of the workpiece W, and may include a recess 62 to accommodate protruding portions of the workpiece W such as flanges or rails. If desired, the die 58 or a portion thereof may be heated. For example, the working face 62 of the die 58 may be made from a layer of steel or another thermally conductive material which can be adapted to electric resistance heating.

Figure 6:
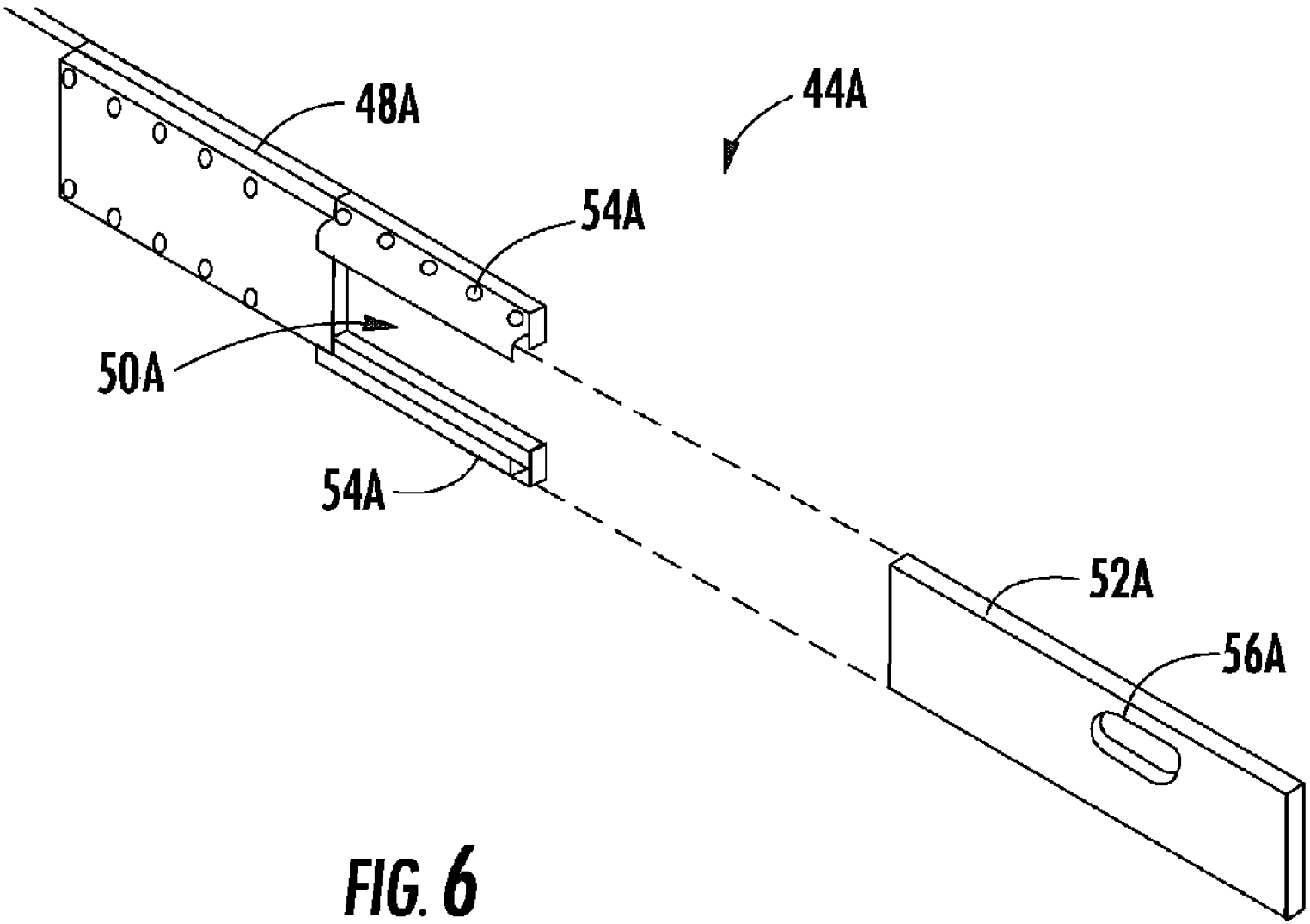
FIG. 6 is an exploded view of a portion of the die enclosure, showing the construction of a side door thereof.

FIG. 6 illustrates one of the side walls 44A, which is representative of the other side wall 44B, in more detail. The side wall 44A comprises a stationary panel 48A which defines a relatively large side opening 50A. A side door 52A is mounted to the stationary panel 48A, for example with Z-brackets 54A, so that it can slide forwards and backwards with the workpiece W during a forming process while maintaining close contact with the stationary panel 48A. The side door 52A has a workpiece opening 56A formed therethrough which is substantially smaller than the side opening 50A, and is ideally just large enough to allow a workpiece W to pass therethrough. Other structures which are capable of allowing movement of the workpiece ends while minimizing workpiece exposure may be substituted for the side walls 44 without affecting the basic principle of the die enclosure 24.

During the stretch-forming operation, the workpiece W will be heated to temperatures of about 538° C. (1000° F.) or greater. Therefore, the die 58 is constructed of a material or combination of materials which are thermally insulated. The key characteristics of these materials are that they resist heating imposed by contact with the workpiece W, remain dimensionally stable at high temperatures, and minimize heat transfer from the workpiece W. It is also preferred that the die 58 be an electrical insulator so that resistance heating current from the workpiece W will not flow into the die 58. In the illustrated example, the die 58 is constructed from multiple pieces of a ceramic material such as fused silica. The die 58 may also be fabricated from other refractory materials, or from non-insulating materials which are then coated or encased by an insulating layer.

Because the workpiece W is electrically isolated from the stretch forming apparatus 10, the workpiece W can be heated using electrical resistance heating. A connector 64 (see FIG. 7) from a currently source may be placed on each end of the workpiece W, Alternatively, the heating current connection may be directly through the jaws 26, as described above. By using thermocouples or other temperature-sensing devices (not shown), the current source can be PLC controlled using a temperature feedback signal. This will allow proper ramp rates for rapid but uniform heating, as well as allow for the retardation of current once the workpiece W reaches the target temperature. A PID control loop of a known type can provided to allow for adjustments to be automatically made as the workpiece temperature varies during the forming cycle. This control may be active and programmable during the forming cycle.

Figure 7:
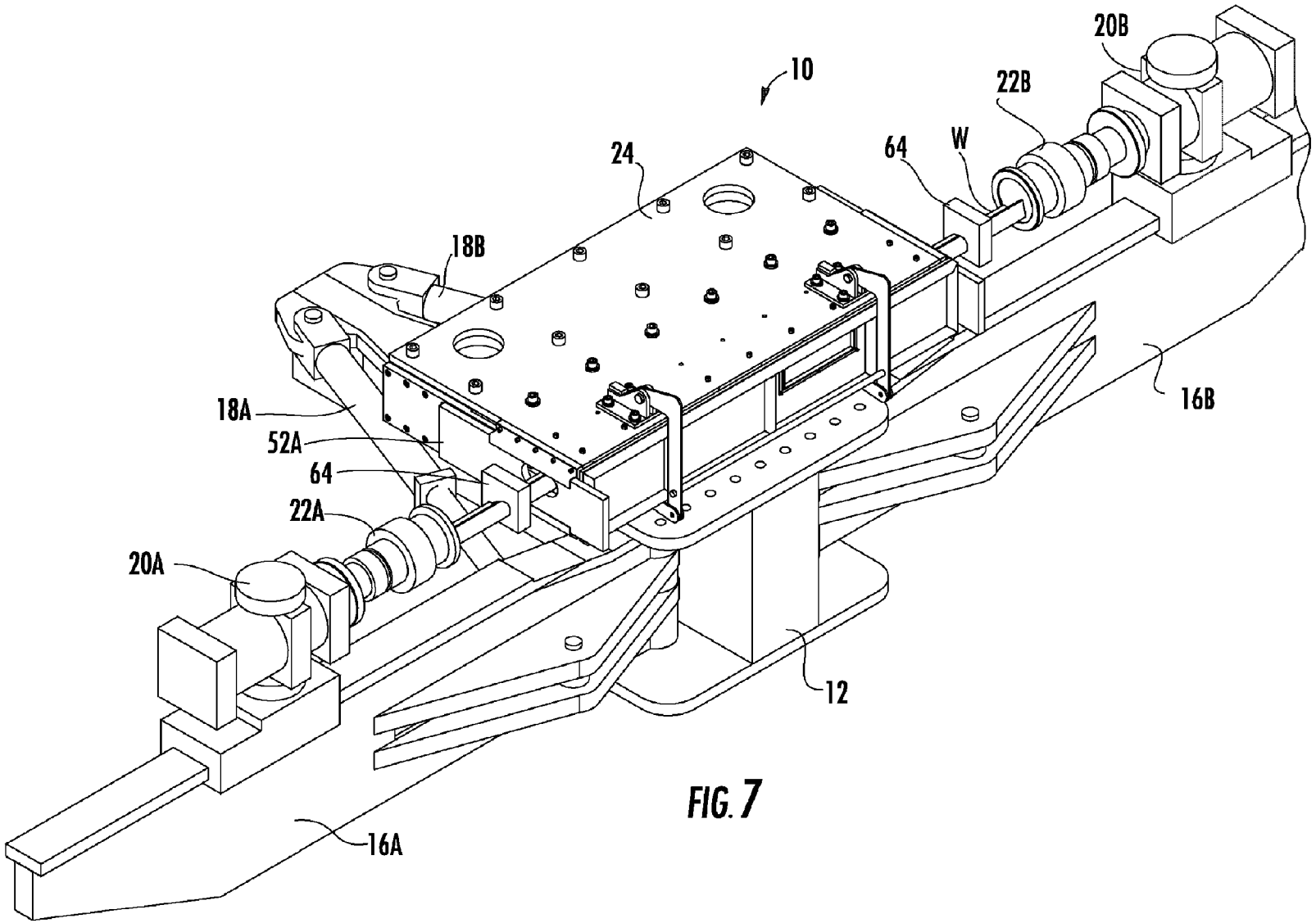
FIG. 7 is a perspective view of the stretch-forming apparatus shown in FIG. 1 with a workpiece loaded therein and ready to be formed.
Figure 8:
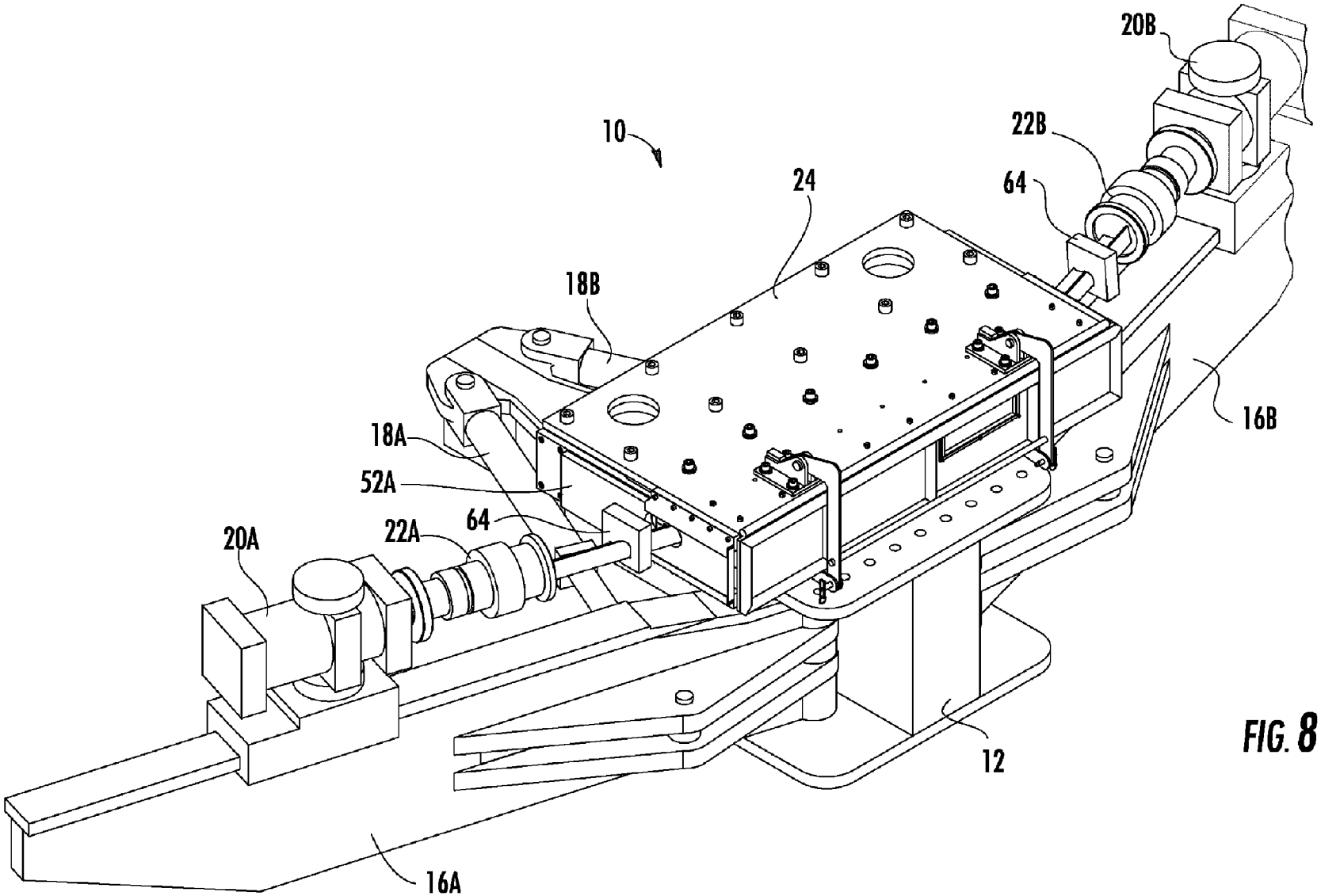
FIG. 8 is another perspective view of the stretch-forming apparatus with a workpiece fully formed.
Figure 9A:
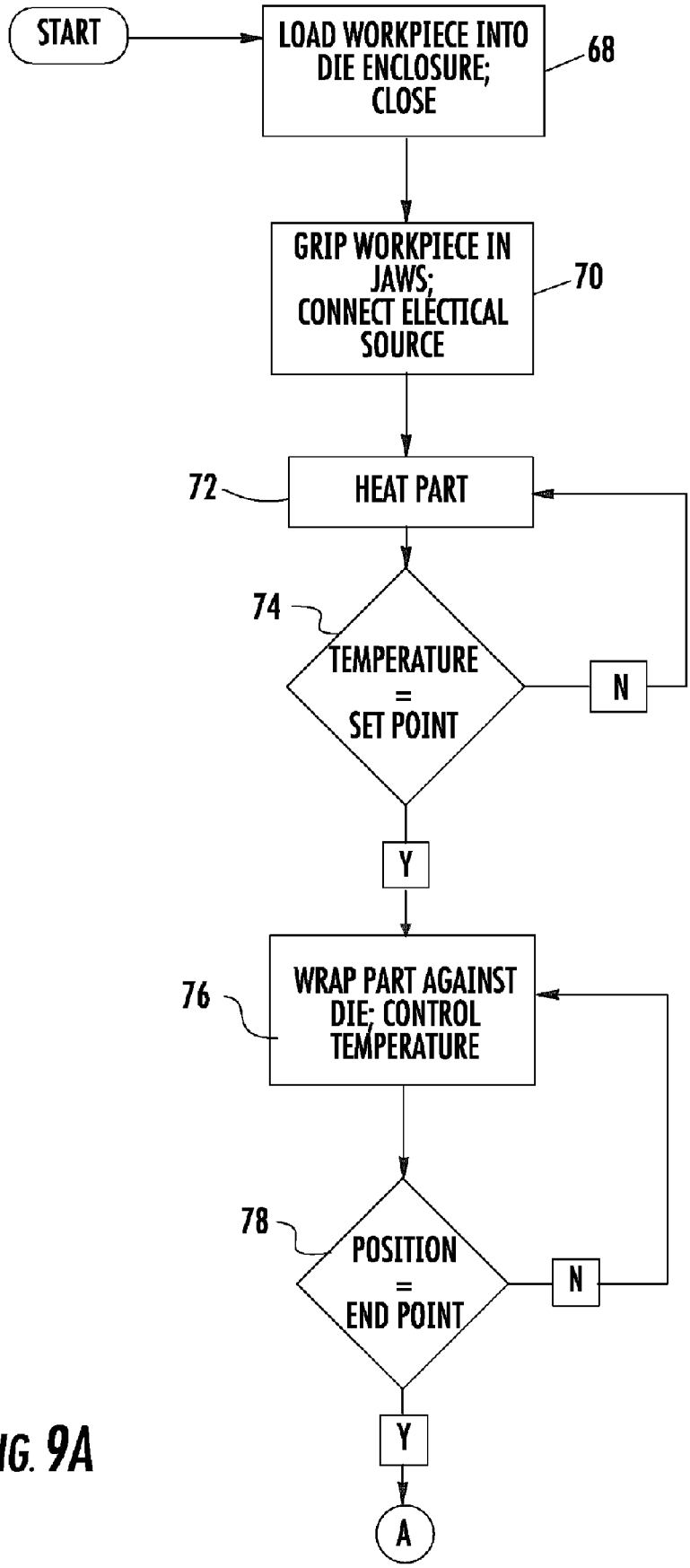
FIG. 9A is a block diagram illustrating an exemplary forming method using the stretch-forming apparatus.
Figure 9B:
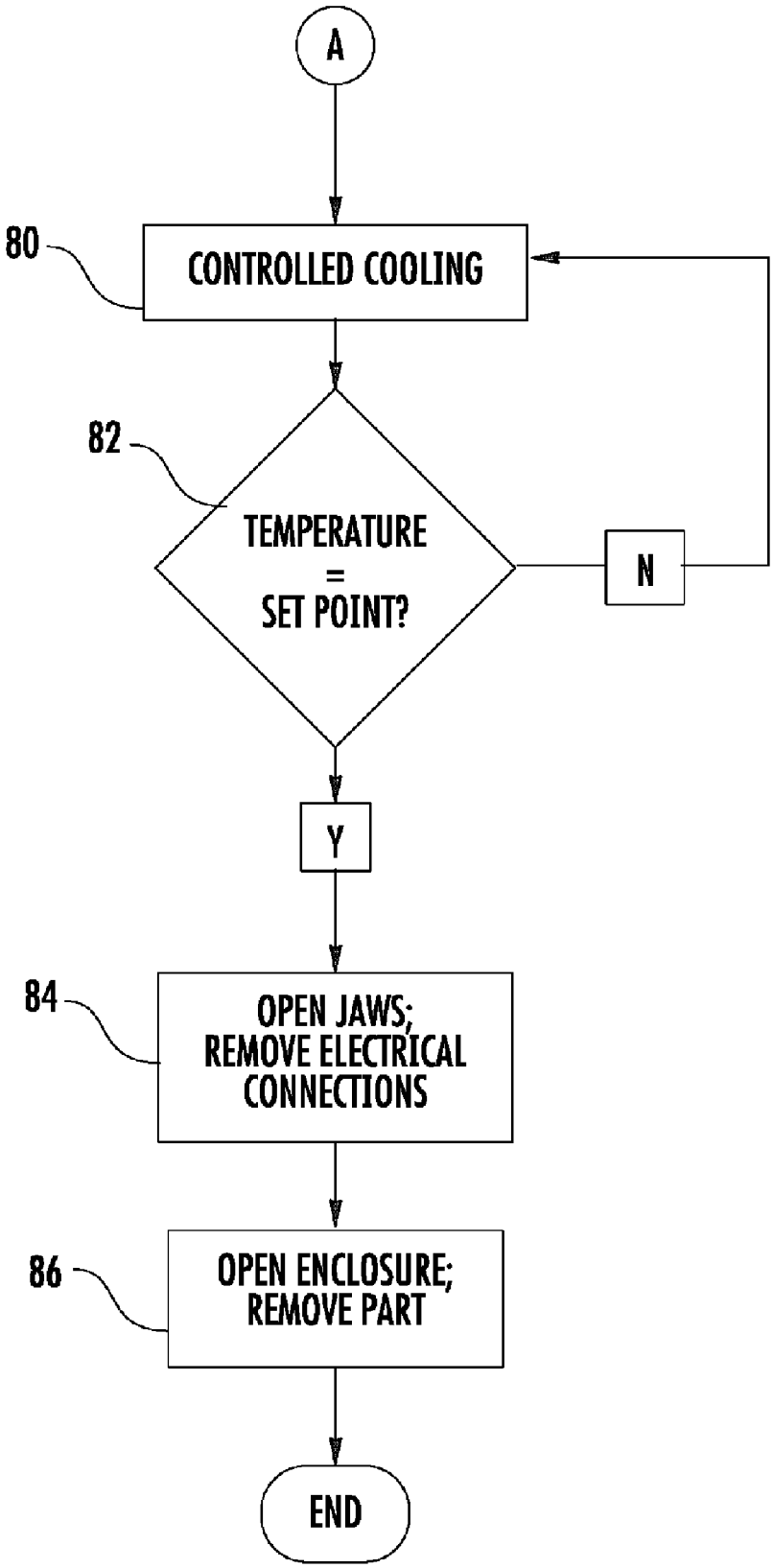
FIG. 9B is a continuation of the block diagram of FIG. 9A.

An exemplary forming process using the stretch forming apparatus 10 is described with reference to FIGS. 7 and 8, and the block diagram contained in FIGS. 9A and 9B. First, at block 68, workpiece W is loaded into the die enclosure 24, with its ends protruding from the workpiece openings 56, and the front door 46 is closed. The side doors 52 are in their forward-most position. This condition is shown in FIG. 7. As noted above, the process is particularly useful for workpieces W which are made from titanium or alloys thereof. However, it may also be used with other materials where hot-forming is desired. Certain workpiece profiles require the use of flexible backing pieces or "snakes" to prevent the workpiece cross section from becoming distorted during the forming cycle. In this application, the snakes used would be made of a high temperature flexible insulating material where practical. If required, the snakes could be made from high temperature heated materials to avoid heat loss from the workpiece W.

Any connections to thermocouples or additional feedback devices for the control system are connected during this step. Once inside the die enclosure 24, the ends of the workpiece W are positioned in the jaws 26 and the jaws 26 are closed, at block 70. If separate electrical heating connections 64 are to be used, they are attached to the workpiece W, using a thermally and electrically conductive paste as required to achieve good contact.

In the loop illustrated at blocks 72 and 74, current is passed through the workpiece W, causing resistance heating thereof. Closed loop controlled heating of the workpiece W continues utilizing feedback from the thermocouples or other temperature sensors until the desired working temperature set point is reached. The rate of heating of the workpiece to the set point is determined taking into account the workpiece cross-section and length as well as the thermocouple feedback.

Once the working temperature has been reached, the workpiece forming can begin. Until that set point is reached, closed loop heating of the workpiece W continues.

In the loop shown at blocks 76 and 78, the tension cylinders 20 stretch the workpiece W longitudinally to the desired point, and the main cylinders 18 pivot the swing arms 16 inward to wrap the workpiece W against the die 58 while the working temperature is controlled as required. The side doors 52 slide backwards to accommodate motion of the workpiece ends. This condition is illustrated in FIG. 8. The stretch rates, dwell times at various positions, and temperature changes can be controlled via feedback to the control system during the forming process. Once position feedback from the swing arms 16 indicates that the workpiece W has arrived at its final position, the control maintains position and/or tension force until the workpiece W is ready to be released. Until that set point is reached, the control will continue to heat and form the workpiece W around the die. Creep forming may be induced by maintaining the workpiece W against the die 58 for a selected dwell time while the temperature is controlled as needed.

In the loop shown in blocks 80 and 82, the workpiece W is allowed to cool at a rate slower than natural cooling by adding supplemental heat via the current source. This rate of temperature reduction is programmed and will allow the workpiece W to cool while monitoring it via temperature feedback.

Once the temperature has arrived at its final set point, force on the workpiece W is released and the flow of current from the current source stops. Until that final set point is reached, the control will maintain closed loop heating sufficient to continue to cool the workpiece W at the specified rate.

After the force is removed from the workpiece W, the jaws 26 may be opened and the electrical clamps removed (block 84).

After opening the jaws 26 and removing the electrical connectors 64, the die enclosure 24 may be opened and the workpiece W removed. The workpiece W is then ready for additional processing steps such as machining, heat treatment, and the like.

The process described above allows the benefits of stretch-forming and creep-forming, including inexpensive tooling and good repeatability, to be achieved with titanium components. This will significantly reduce the time and expense involved compared to other methods of forming titanium parts. Furthermore, isolation of the workpiece from the outside environment encourages uniform heating and minimizes heat loss to the environment, thereby reducing overall energy requirements. In addition, the use of the die enclosure 24 enhances safety by protecting workers from contact with the workpiece W during the cycle.

An apparatus and method for stretch-forming of titanium is described above. Various details of the invention may be changed without departing from its scope. Furthermore, the foregoing description of the preferred embodiment of the invention and the best mode for practicing the invention are provided for the purpose of illustration only and not for the purpose of limitation.

What is claimed is:

1. A method of stretch-forming a metal workpiece, comprising the steps of:

(a) providing a heat-insulating enclosure that includes first and second aligned and opposed workpiece openings in respective first and second spaced-apart sidewalls of the enclosure between which a die with a working face having a predetermined cross-sectional profile is positioned to receive the workpiece;

(b) providing first and second opposed jaws mounted on respective first and second opposed swing arms;

(c) positioning the workpiece in the enclosure in forming proximity to the working face of the die with its opposite ends extending through respective ones of the first and second openings in sidewalls of the enclosure;

(d) electrically insulating the workpiece;

(e) gripping the workpiece in the jaws at its opposite ends;

(f) resistance heating the workpiece to a working temperature by passing electrical current through the workpiece;

(g) moving the workpiece and the working face of the die relative to each other while the workpiece is at the working temperature, thereby forming the workpiece against the working face of the die into a preselected form; and (h) cooling the workpiece while the workpiece is in the preselected form against the working face of the die.

2. A method of stretch-forming a metal workpiece according to claim 1, and including the step of resistance heating the workpiece by passing electric current through the jaws to the workpiece.

3. A method of stretch-forming a metal workpiece according to claim 1, and including a step of electrically-insulating the die against passage of electric current from the workpiece to the die.

4. A method of stretch-forming a metal workpiece according to claim 3, wherein the die is electrically-insulated from the workpiece with ceramic material.

5. A method of stretch-forming a metal workpiece according to claim 1, and including a step of providing a sliding panel in each of the first and second spaced-apart sidewalls of the enclosure, the first and second workpiece openings being formed in respective ones of the sliding panels and having a size and shape only just large enough to receive the workpiece therethrough and adapted to move along the sidewalls of the enclosure as the workpiece is formed for reducing heat loss through the workpiece openings.

6. A method of stretch-forming a metal workpiece according to claim 1, wherein the enclosure is stationarily mounted on a substantially rigid main frame defining a die mounting surface, and the opposed swing arms are pivotally mounted to the main frame and coupled to respective hydraulic forming cylinders that control movement of the swing arms.

7. A method of stretch-forming a metal workpiece according to claim 1, and including a step of electrically insulating the jaws from the workpiece by applying an insulating barrier to portions of the jaws that contact the workpiece.

8. A method of stretch-forming a metal workpiece according to claim 1, and including steps of sensing by means of position feedback from the swing arms that the workpiece has arrived at a final forming position, maintaining the final forming position until a workpiece release set point is reached, and continuing to heat and form the workpiece around the die until the release set point is reached.

9. A method of stretch-forming a metal workpiece, comprising the steps of:

(a) providing a heat-insulating enclosure that includes first and second aligned and opposed workpiece openings in respective first and second spaced-apart sidewalls of the enclosure between which a die with a working face having a predetermined cross-sectional profile is positioned to receive the workpiece;

(b) providing a sliding panel in each of the first and second spaced-apart sidewalls of the enclosure, the first and second workpiece openings being formed in respective ones of the sliding panels and having a size and shape only just large enough to receive the workpiece therethrough and adapted to move along the sidewalls of the enclosure as the workpiece is formed for reducing heat loss through the workpiece openings;

(c) providing first and second opposed jaws mounted on respective first and second opposed swing arms;

(d) positioning the workpiece in the enclosure in forming proximity to the working face of the die with its opposite ends extending through respective ones of the first and second openings in sidewalls of the enclosure;

(e) electrically insulating the die against passage of electric current from the workpiece to the die with a ceramic material;

(f) gripping the workpiece in the jaws at its opposite ends;

(g) resistance heating the workpiece to a working temperature by passing electrical current through jaws to the workpiece; and (h) moving the workpiece and the working face of the die relative to each other while the workpiece is at the working temperature, thereby forming the workpiece against the working face of the die into a preselected form.

10. The stretch-forming method of claim 9, and further comprising a step of creep forming the workpiece by steps of:

(a) sensing by means of position feedback from the swing arms that the workpiece has arrived at a final forming position;

(b) maintaining the final forming position until a workpiece release set point is reached;

(c) continuing to heat and form the workpiece around the die until the release set point is reached; and (d) cooling the workpiece while the workpiece is in the preselected form against the working face of the die.

* * * * *